US007015645B2

(12) United States Patent
Kim et al.

(10) Patent No.: US 7,015,645 B2
(45) Date of Patent: Mar. 21, 2006

(54) PLASMA DISPLAY PANEL HAVING DUMMY BARRIER RIBS

(75) Inventors: Woo-Tae Kim, Yongin (KR); Eun-Gi Heo, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 335 days.

(21) Appl. No.: 10/654,194

(22) Filed: Sep. 3, 2003

(65) Prior Publication Data

US 2004/0075389 A1 Apr. 22, 2004

(30) Foreign Application Priority Data

Sep. 4, 2002 (KR) ..... 10-2002-0053225

(51) Int. Cl.
*H01J 17/49* (2006.01)

(52) U.S. Cl. ..... 313/586; 313/582; 313/292

(58) Field of Classification Search ..... 313/582–587, 313/292

See application file for complete search history.

(56) References Cited

U.S. PATENT DOCUMENTS 6,661,170 B1 * 12/2003 Amemiya ..... 313/582
2004/0046505 A1 * 3/2004 Kawanishi ..... 313/586

FOREIGN PATENT DOCUMENTS

JP 2001-35381 2/2001
JP 2001-160360 6/2001
KR 2001-0000980 1/2001

OTHER PUBLICATIONS

Patent Abstracts of Japan for Publication No. 2001-160360, date of publication Jun. 12, 2001, for inventors Saito Hiroshi et al.

Korean Patent Abstracts for Publication No. 010000980, date of publication Jan. 5, 2001, for inventors Il Jun Bae et al.

* cited by examiner

*Primary Examiner*—Joseph L. Williams
(74) *Attorney, Agent, or Firm*—Christie, Parker and Hale, LLP

(57) ABSTRACT

A plasma display panel includes first and second substrates that are substantially parallel to each other with a predetermined gap therebetween. The substrates include a display region and a non-display region. Barrier ribs are mounted between the first and second substrates within the display region and define discharge cells. The barrier ribs include an outermost barrier rib located at an edge of the display region. Dummy barrier ribs are mounted between the first and second substrates within the non-display region. The dummy barrier ribs include a first sub barrier rib disposed at a predetermined distance from the outermost barrier rib, and at least one second sub barrier rib connected to the first sub barrier rib and the outermost barrier rib.

21 Claims, 7 Drawing Sheets

PLASMA DISPLAY PANEL HAVING DUMMY BARRIER RIBS

CROSS-REFERENCE TO RELATED APPLICATIONS

This application claims priority to and the benefit of Korean Patent Application No. 2002-0053225 filed on Sep. 4, 2002 in the Korean Intellectual Property Office, the entire content of which is incorporated herein by reference.

BACKGROUND OF THE INVENTION (a) Field of the Invention

The present invention relates to a plasma display panel (PDP), and more particularly, to a PDP in which dummy barrier ribs are formed in non-display regions.

(b) Description of the Related Art

Plasma display panels (PDPs) are emerging as one of the most popular flat panel display configurations used for wall-mounted televisions and other similar display applications. Predetermined images are displayed on the PDP using a discharge mechanism of discharge cells.

The discharge cells are formed using barrier ribs that are provided in a predetermined pattern (e.g., a striped or lattice pattern) on a substrate. The barrier ribs include real barrier ribs (hereinafter referred to simply as 'barrier ribs'), which are provided in a display region, and dummy barrier ribs, which are provided in non-display regions.

In other words, the dummy barrier ribs refer to the barrier ribs formed in non-display regions that are outside the display region, such that structural elements of the plasma display panel formed in the display region, i.e., a dielectric layer, a protection layer, address electrodes, barrier ribs, and phosphors, may be formed in the display region to a stable thickness.

However, dummy discharge cells are formed in the non-display regions by the dummy barrier ribs, and discharge occurs in the dummy discharge cells even when it does not occur in the discharge cells formed in the display region, thereby reducing picture quality. Such mis-discharge in the dummy discharge cells occurs as a result of electric charges generated in discharge cells adjacent to non-display regions passing over the barrier ribs of the discharge cells and into the dummy discharge cells in the non-display regions. These electric charges accumulate in the barrier ribs of the dummy discharge cells and cause discharge to occur in the dummy discharge cells.

To prevent this problem, a volume of the dummy discharge cells may be reduced (e.g., by removing spaces from the dummy discharge cells) such that mis-discharge does not occur. Japanese Laid-Open Patent No. 2001-35381 discloses one such configuration, in which spaces for the dummy discharge cells are filled in with the same material as the dummy barrier ribs, thereby effectively increasing the width of the dummy barrier ribs and removing spaces from the dummy discharge cells.

In all display devices including the PDP, it is desirable for the brightness to be evenly distributed over the entire display region. However, with a PDP having such dummy barrier ribs with spaces for the dummy discharge cells filled in, brightness at the edge between the display and non-display regions is greater than brightness within the display region such that overall brightness characteristics are deteriorated.

This problem is caused by the following phenomenon. In the case where the width of the dummy barrier ribs is made larger than the width of the barrier ribs inside the display region, the dummy barrier ribs tend to contract more than the barrier ribs in the display region when a paste used to form the dummy barrier ribs is baked following the deposition of the same. Hence, the volume of the discharge cells at edges of the display region is increased, thereby resulting in an uneven brightness.

SUMMARY OF THE INVENTION

In one exemplary embodiment of the present invention, there is provided a PDP that prevents mis-discharge in non-display regions and that realizes even brightness over a display region.

In an exemplary embodiment of the present invention, there is provided a PDP, which includes first and second substrates that are substantially parallel to each other with a predetermined gap therebetween. The substrates include a display region and a non-display region. The PDP also includes a plurality of address electrodes formed on the first substrate and a first dielectric layer formed on the first substrate. The first dielectric layer covers the plurality of address electrodes. The PDP also includes a plurality of barrier ribs mounted between the first and second substrates within the display region. The plurality of barrier ribs define discharge cells and include an outermost barrier rib located at an edge of the display region. In addition, the PDP includes dummy barrier ribs mounted between the first and second substrates within the non-display region. The dummy barrier ribs include a first sub barrier rib disposed at a predetermined distance from the outermost barrier rib, and at least one second sub barrier rib connected to the first sub barrier rib and the outermost barrier rib. The PDP also includes a phosphor layer formed within the discharge cells, a plurality of sustain electrodes formed on a surface of the second substrate that faces the first substrate, a second dielectric layer formed on the surface of the second substrate, and discharge gas provided in the discharge cells. The second dielectric layer covers the plurality of sustain electrodes.

In another exemplary embodiment of the present invention, the first sub barrier rib has a width that is substantially identical to a width of one of the plurality of barrier ribs.

In yet another exemplary embodiment of the present invention, the first sub barrier rib is substantially parallel to the plurality of barrier ribs, and the at least one second sub barrier rib is substantially orthogonal to the first sub barrier rib and the outermost barrier rib.

In still another exemplary embodiment according to the present invention, the plurality of sustain electrodes include pairs of sustain electrodes, each pair corresponding to a row of the discharge cells, wherein the at least one second sub barrier rib is mounted between at least one of the pairs of sustain electrodes. In a particular exemplary embodiment, one second sub barrier rib is disposed between one of the pairs of sustain electrodes. Alternatively, one of the at least one second sub barrier rib may be disposed between each pair of sustain electrodes. Further, one of the at least one second sub barrier rib may be selectively disposed between at least one of the pairs of sustain electrodes.

The plurality of barrier ribs may be formed in a lattice pattern or a striped pattern. Further, the first sub barrier rib may be formed in a striped pattern.

In a further exemplary embodiment of the present invention, the plurality of barrier ribs include a secondary outermost barrier rib connected to the outermost barrier rib and forming discharge cell with at least one other of the plurality of barrier ribs.

In a yet further exemplary embodiment, of, the present invention, a distance between the outermost barrier rib and the secondary outermost barrier rib is less than a distance between others of the plurality of barrier ribs.

In a still further exemplary embodiment of the present invention, there is provided a PDP that includes first and second substrates that are substantially parallel to each other with a predetermined gap therebetween. The substrates include a display region and a non-display region. A plurality of barrier ribs are mounted between the first and second substrates within the display region. The plurality of barrier ribs define discharge cells and include an outermost barrier rib located at an edge of the display region. Dummy barrier ribs are mounted between the first and second substrates within the non-display region. The dummy barrier ribs include a first sub barrier rib disposed at a predetermined distance from the outermost barrier rib, and at least one second sub barrier rib connected to the first sub barrier rib and the outermost barrier rib. The first sub barrier rib is substantially parallel to the plurality of barrier ribs.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Exemplary embodiments of the present invention will now be described in detail with reference to the accompanying drawings.

Figure 1:
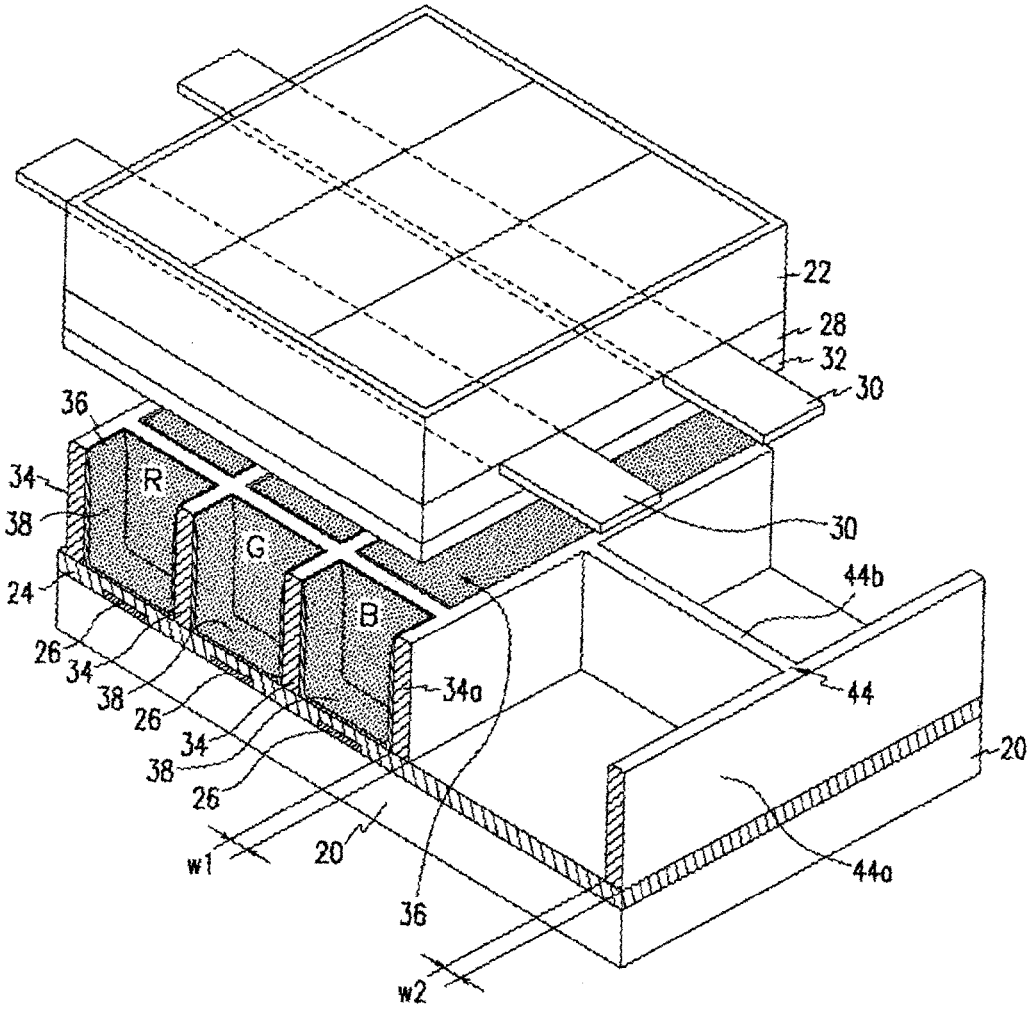
FIG. 1 is a partial exploded perspective view of a PDP according to an exemplary embodiment of the present invention.

FIG. 1 is a partial exploded perspective view of a plasma display panel (PDP) according to an exemplary embodiment of the present invention. As shown in FIG. 1, the PDP includes a first substrate 20 and a second substrate 22 that are substantially parallel to each other with a predetermined gap therebetween, and a discharge mechanism provided between the first and second substrates 20 and 22. The display mechanism is used to display images on the PDP.

In the exemplary embodiment, address electrodes 26 are formed on a surface of the first substrate 20 that faces the second substrate 22. The address electrodes 26 are provided in parallel at predetermined intervals to realize a striped pattern. A first dielectric layer 24 is also formed on the surface of the first substrate 20 and covers the address electrodes 26. Further, sustain electrodes 30 are formed on a surface of the second substrate 22 that faces the first substrate 20. The sustain electrodes 30 are provided in parallel at predetermined intervals to realize a striped pattern. A second dielectric layer 28 is also formed on the surface of the second substrate 22 and covers the sustain electrodes 30. The sustain electrodes 30 are substantially orthogonal to the address electrodes 26. Further, the sustain electrodes 30 are formed of a transparent material such as ITO (indium tin oxide).

In addition, a transparent protection layer 32 made of a material such as MgO (magnesium oxide) is formed over the second dielectric layer 28 of the second substrate 22, and barrier ribs 34 are formed between the first and second substrates 20 and 22. The barrier ribs 34 are substantially parallel to the address electrodes 26 and formed between the same. Further, the barrier ribs 34 define discharge cells 36 by spaces formed therebetween. Discharge gas (not shown) is provided in the discharge cells 36. Phosphor layers 38 that includes R, G, and B phosphors are formed on the first dielectric layer 24 of the first substrate 20 and on inner walls of the barrier ribs 34.

Figure 2:
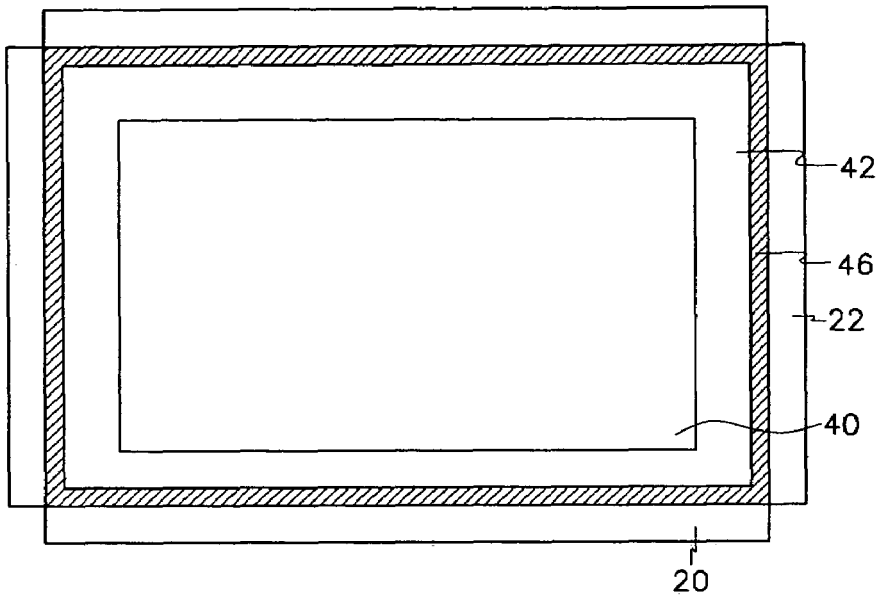
FIG. 2 is a plan view of the PDP of FIG. 1.

Referring also to FIG. 2, the first and second substrates include a display region 40 and non-display region 42 that surrounds the display region. The barrier ribs 34 are formed within the display region 40 of the first and second substrates 20 and 22. In the described exemplary embodiment, the barrier ribs 34 are formed in a lattice pattern. However, the present invention is not limited to this configuration and other patterns such as a striped pattern may be used in other exemplary embodiments.

In the described exemplary embodiment, dummy barrier ribs 44 are also formed between the first and second substrates 20 and 22. The dummy barrier ribs 44 are formed in a non-display region 42 (see FIG. 2). The dummy barrier ribs 44 are formed such that mis-discharge in the non-display region 42 is prevented and brightness in the display region 40 is uniformly distributed.

Figure 3:
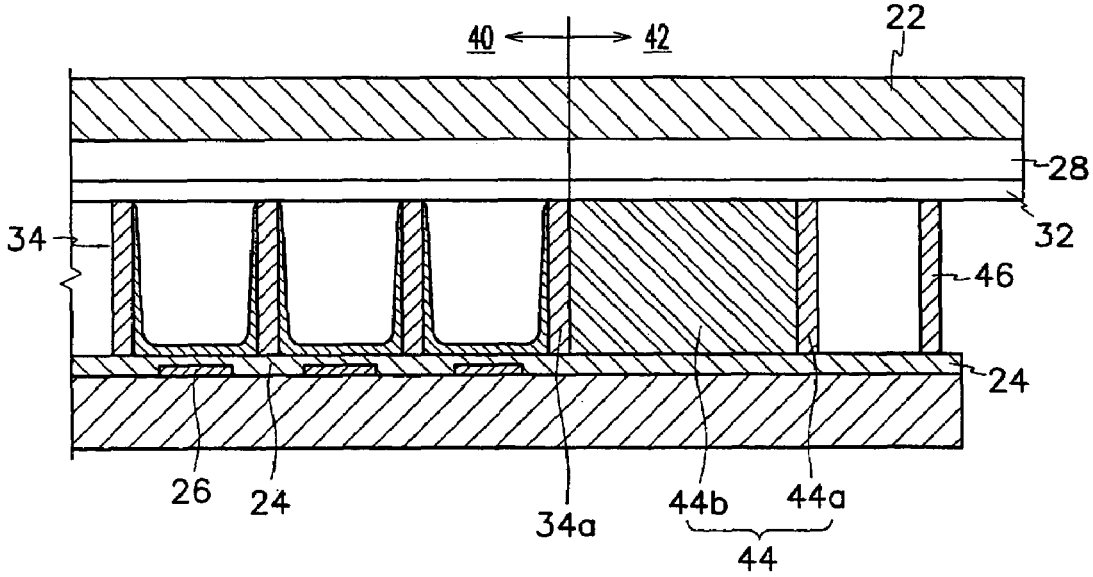
FIG. 3 is a partial sectional view of the PDP of FIG. 1.

Referring also to FIG. 3, dummy barrier ribs 44 include a first sub barrier rib 44*a* having a width w2 that is substantially identical to a width w1 of the barrier ribs 34 in the display region 40, and at least one second sub barrier rib 44*b* provided between and connected to the first sub barrier rib 44*a* and an outermost barrier rib 34*a*. In FIGS. 1 and 3, the height of the at least one second sub barrier rib 44*b* is substantially identical to the height of the first sub barrier rib 44*a*. In other embodiments, however, the heights may be different. FIGS. 1 and 3 each show only one first sub barrier rib 44*a*. In other embodiments, however, more than one first sub barrier rib may be formed in the non-display region, and the first sub barrier ribs may have various different patterns such as lattice, striped, etc. The outermost barrier rib 34*a* is formed at an edge of the display region 40 (i.e., at a boundary between the display region 40 and the non display region 42 as shown in FIG. 3).

The first sub barrier rib 44*a* is disposed at a predetermined distance (d) from the outermost barrier rib 34*a* and is substantially parallel to the same. The at least one second sub barrier rib 44*b* is substantially orthogonal to the first sub barrier rib 44*a* and the outermost barrier ribs 34*a*, and is connected to both of them as described above.

Figure 4:
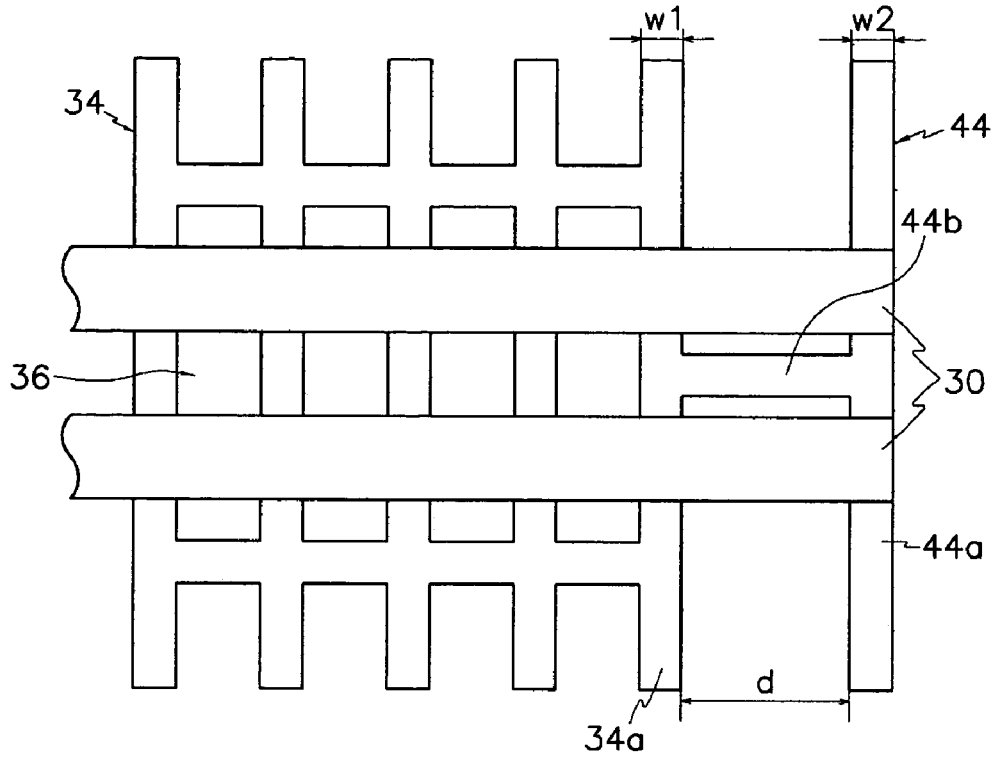
FIG. 4 is a schematic view used to illustrate a relationship between dummy barrier ribs and sustain electrodes of a plasma PDP according to an exemplary embodiment of the present invention.
Figure 5:
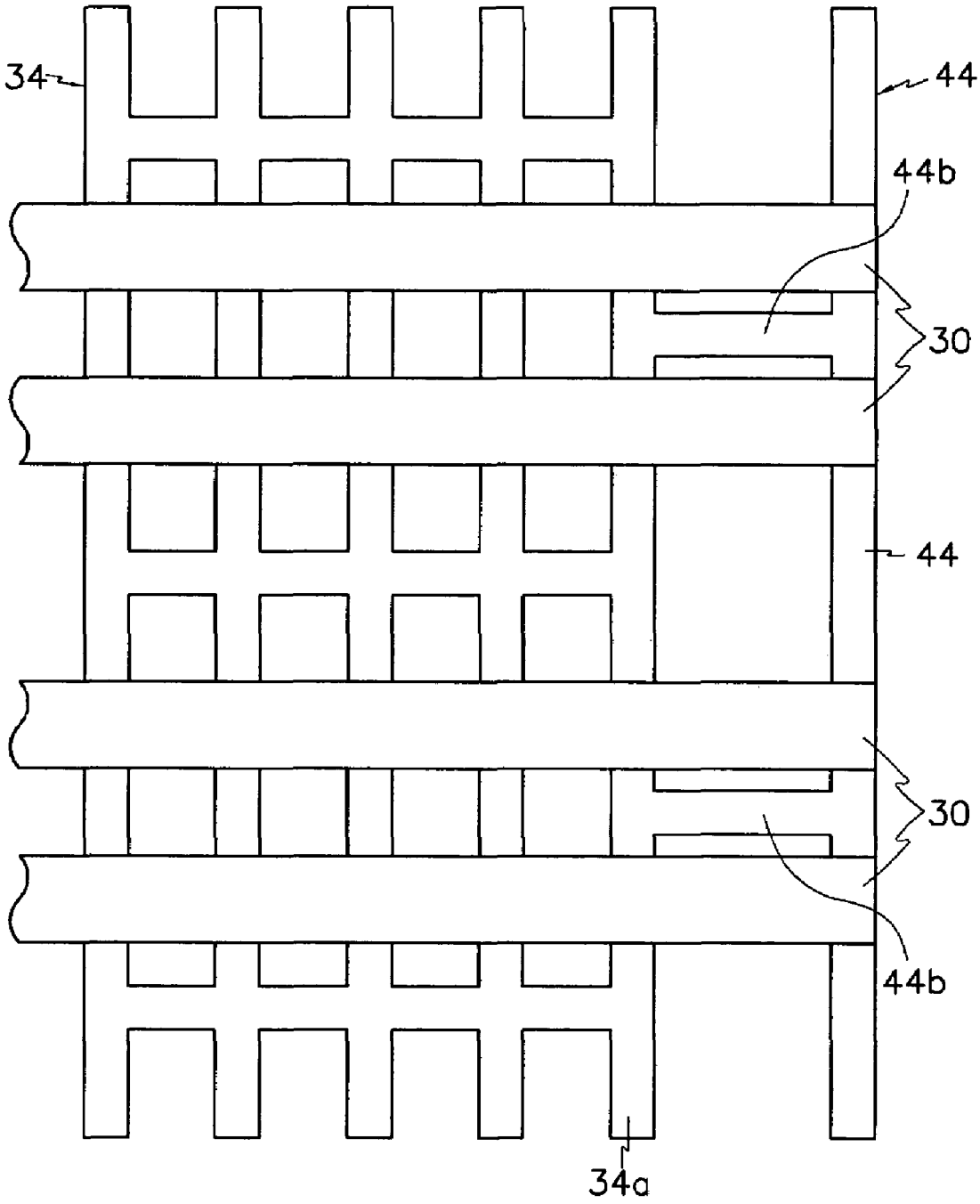
FIGS. 5 and 6 are schematic views used to illustrate a relationship between dummy barrier ribs and sustain electrodes of a PDP according to other exemplary embodiments of the present invention.
Figure 6:
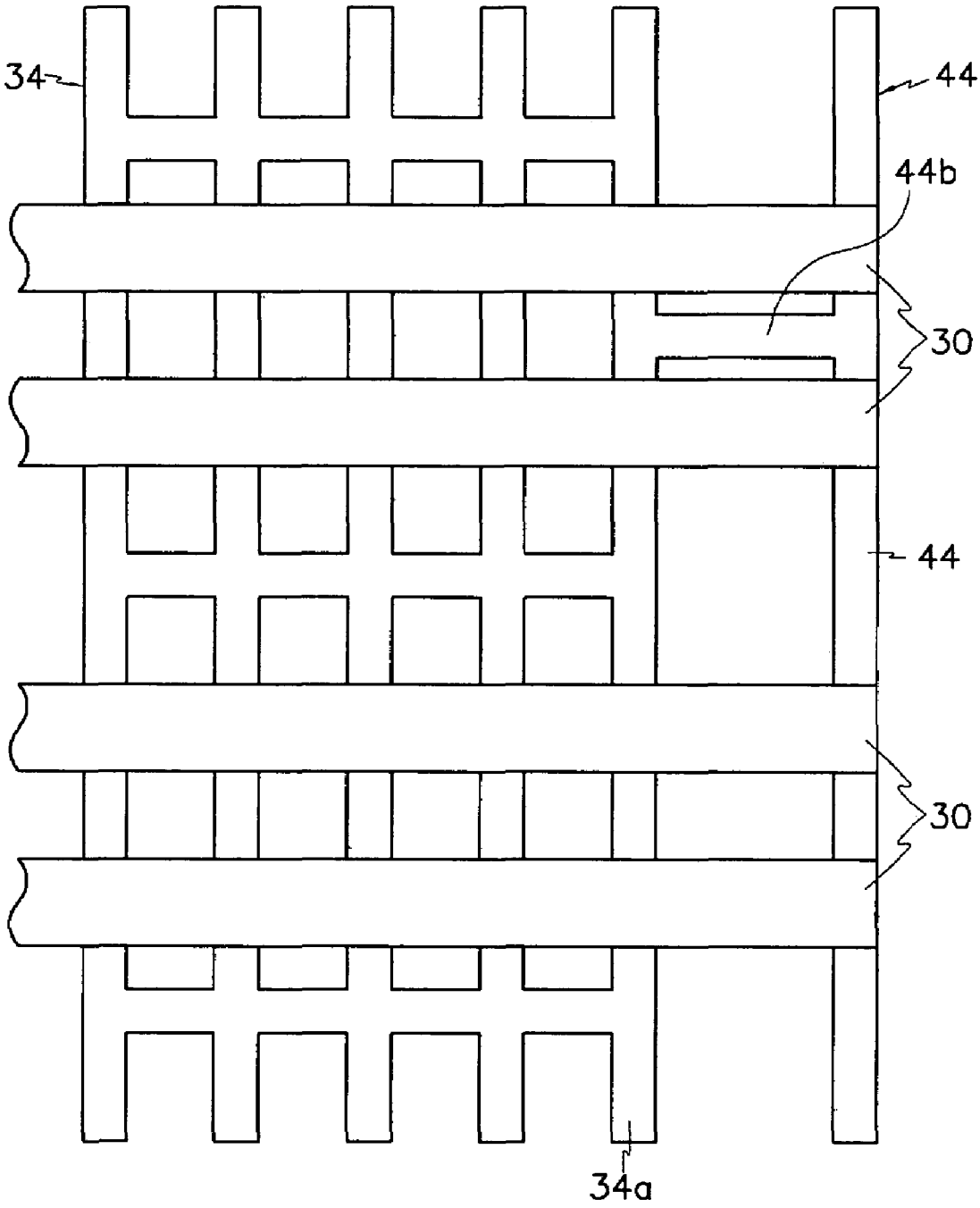

With reference also to FIG. 4, in a state where the first substrate 20 and the second substrate 22 are interconnected, the at least one second sub barrier rib 44*b* is mounted between two sustain electrodes 30, which form a pair of sustain electrodes provided for each row of the discharge cells 36, to interconnect the first sub barrier rib 44*a* and the outermost barrier rib 34*a*. The second sub barrier rib 44*b* may be provided between only one of the pairs of the sustain electrodes 30 as shown in FIG. 4. In an alternate embodiment, one second sub barrier rib 44*b* may be provided between each pair of the sustain electrodes 30 as shown in FIG. 5. Further, at least one second sub barrier rib 44*b* may be selectively mounted between at least one pair of the sustain electrodes 30 as shown in FIG. 6.

In the PDP having the dummy barrier ribs 44 as described above, the first and second substrates 20 and 22 are placed substantially parallel to one another, then sealed using a frit 46 provided in peripheral areas of the substrates 20 and 22, thereby forming an integral assembly.

In the resulting PDP, mis-discharge is prevented from occurring in the non-display region 42 by the configuration of the dummy barrier ribs 44. This is a result of reducing spaces in which discharge can take place in the non-display region by the mounting of at least one second sub barrier rib 44*b* between the sustain electrodes 30.

Further, since the first sub barrier rib 44*a* of the dummy barrier ribs 44 has the same width as the barrier ribs 34 formed in the display region 40, even if shrinkage (i.e., contraction) occurs during the baking portion of the PDP manufacturing process, the first sub barrier rib 44*a* shrinks the same amount as the barrier ribs 34 in the display region 40. Accordingly, the size of the discharge cells 36 formed by the barrier ribs 34 is not affected so that the brightness is uniform over the entire area of the display region 40.

Figure 7:
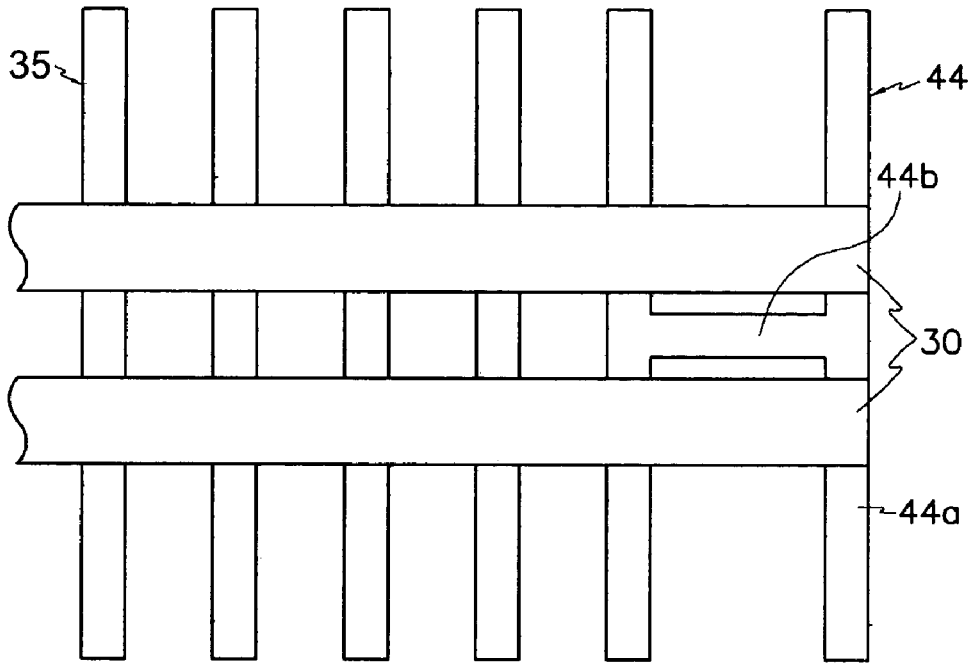
FIGS. 7 and 8 are schematic views used to illustrate a relationship between dummy barrier ribs and sustain electrodes of a PDP according to yet other exemplary embodiments of the present invention.

Referring now to FIG. 7, there is shown; another exemplary embodiment in which barrier ribs 35 formed in the display region 40 are provided in a striped pattern.

Figure 8:
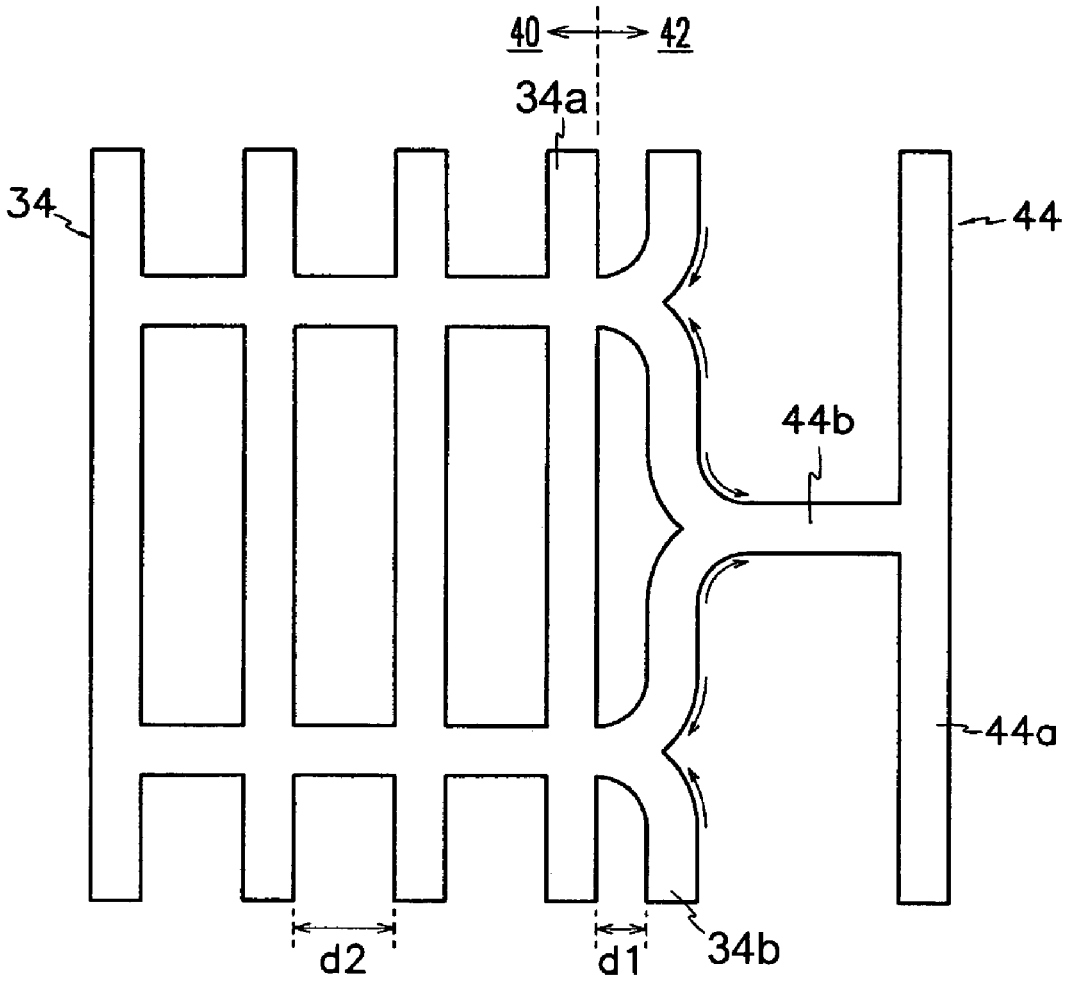

With reference to FIG. 8, for example, a secondary outermost barrier rib 34*b* is additionally provided that is connected to the outermost barrier rib 34*a*. The secondary outermost barrier rib 34*b* is located between the outermost barrier rib 34*a* and the dummy barrier ribs 44. Hence, the secondary outermost barrier rib 34*b*, instead of the outermost barrier rib 34*a*, is connected via the at least one second sub barrier rib 44*b* to the first sub barrier rib 44*a*.

In this embodiment, the outermost barrier rib 34*a* forms discharge cells with at least one other of the barrier ribs 34 inside the display region. When the secondary outermost barrier rib 34*b* is connected to the outermost barrier rib 34*a*, the secondary outermost barrier rib 34*b* is mounted in the non-display region 42 and has the same pattern as the barrier ribs 34. A distance (d1) between the outermost barrier rib 34*a* and the secondary outermost barrier rib 34*b* is less than a distance (d2) between the barrier ribs 34 inside the display region 40.

During the baking of the barrier ribs 34 and the dummy barrier ribs 44 as described above, a shape of the secondary outermost barrier rib 34*b* is changed (e.g., see the arrows in FIG. 8) as a result of the connection between the secondary outermost barrier rib 34*b* and the second sub barrier rib 44*b*. In the absence of the secondary outermost barrier rib 34*b*, such shape changing would have occurred to the outermost barrier rib 34*a* such that the outermost barrier rib 34*a* would not have performed its function as a barrier rib. Therefore, the secondary outermost barrier rib 34*b* is provided to be deformed instead of the outermost barrier rib 34*a*.

In the described exemplary embodiment, there is the distance (d1) between the outermost barrier rib 34*a* and the secondary outermost barrier rib 34*b*. Therefore, in theory, discharge cells may be formed between them. However, because the spaces formed between the outermost barrier rib 34*a* and the secondary outermost barrier rib 34*b* are so small that discharge does not occur.

In an alternate embodiment, the secondary outermost barrier rib may be located between the outermost barrier rib 34*a* and one other of the barrier ribs 34 in the display region and form discharge cells with at least one other of the barrier ribs 34 inside the display region. In this embodiment, the secondary outermost barrier rib is mounted within the display region 40 and has the same pattern as the barrier ribs 34. A distance (d1) between the outermost barrier rib 34*a* and the secondary outermost barrier rib is less than a distance (d2) between the barrier ribs 34 inside the display region 40.

During the baking of the barrier ribs 34 and the dummy barrier ribs 44 in the alternate embodiment, a shape of the outermost barrier rib 34*a* is changed as a result of the connection between the outermost barrier rib 34*a* and the second sub barrier rib 44*b* such that the outermost barrier rib 34*a* may not perform its function as a barrier rib. Hence, the secondary outermost barrier rib would function as a barrier rib in this alternate embodiment to form discharge cells within the display region 40. Similar to the exemplary embodiment of FIG. 8, because the spaces formed between the outermost barrier rib 34*a* and the secondary outermost barrier rib are so small that discharge does not occur.

In the PDP of the present invention structured as in the exemplary embodiments described above, as a result of the improvements made in the structure of the dummy barrier ribs, mis-discharge does not occur in the non-display region, and the brightness in the display region is uniformly distributed. Therefore, overall quality of the plasma display panel is improved.

Although the present invention has been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims and equivalents thereof.

What is claimed is:

1. A plasma display panel, comprising:

first and second substrates that are substantially parallel to each other with a predetermined gap therebetween, said substrates comprising a display region and a non-display region;

a plurality of address electrodes formed on the first substrate;

a first dielectric layer formed on the first substrate, the first dielectric layer covering the plurality of address electrodes;

a plurality of barrier ribs mounted between the first and second substrates within the display region, the plurality of barrier ribs defining discharge cells and including an outermost barrier rib located at an edge of the display region;

dummy barrier ribs mounted between the first and second substrates within the non-display region, the dummy barrier ribs comprising:

a first sub barrier rib disposed at a predetermined distance from the outermost barrier rib; and at least one second sub barrier rib connected to the first sub barrier rib and the outermost barrier rib;

a phosphor layer formed within the discharge cells;

a plurality of sustain electrodes formed on a surface of the second substrate that faces the first substrate;

a second dielectric layer formed on the surface of the second substrate, said second dielectric layer covering the plurality of sustain electrodes; and discharge gas provided in the discharge cells.

2. The plasma display panel of claim 1, wherein the first sub barrier rib has a width that is substantially identical to a width of one of the plurality of barrier ribs.

3. The plasma display panel of claim 1, wherein the first sub barrier rib is substantially parallel to the plurality of barrier ribs, and the at least one second sub barrier rib is substantially orthogonal to the first sub barrier rib and the outermost barrier rib.

4. The plasma display panel of claim 1, wherein the plurality of sustain electrodes include pairs of sustain electrodes, each pair corresponding to a row of the discharge cells, and the at least one second sub barrier rib is disposed between at least one of the pairs of the sustain electrodes.

5. The plasma display panel of claim 4, wherein the at least one second sub barrier rib comprises one second sub barrier rib that is disposed between one of the pairs of sustain electrodes.

6. The plasma display panel of claim 4, wherein one of the at least one second sub barrier rib is disposed between each pair of sustain electrodes.

7. The plasma display panel of claim 4, wherein one of the at least one second sub barrier rib is selectively disposed between at least one of the pairs of sustain electrodes.

8. The plasma display panel of claim 1, wherein the plurality of barrier ribs are formed in a lattice pattern.

9. The plasma display panel of claim 1, wherein the plurality of barrier ribs are formed in a striped pattern.

10. The plasma display panel of claim 1, wherein the first sub barrier rib is formed in a striped pattern.

11. The plasma display panel of claim 1, wherein the plurality of barrier ribs includes a secondary outermost barrier rib connected to the outermost barrier rib and forming a discharge cell with at least one other of the plurality of barrier ribs.

12. The plasma display panel of claim 10, wherein a distance between the outermost barrier rib and the secondary outermost barrier rib is less than a distance between others of the plurality of barrier ribs.

13. A plasma display panel comprising:

first and second substrates that are substantially parallel to each other with a predetermined gap therebetween, said substrates comprising a display region and a non-display region;

a plurality of barrier ribs mounted between the first and second substrates within the display region, the plurality of barrier ribs defining discharge cells and including an outermost barrier rib located at an edge of the display region; and dummy barrier ribs mounted between the first and second substrates within the non-display region, the dummy barrier ribs comprising:

a first sub barrier rib disposed at a predetermined distance from the outermost barrier rib, the first sub barrier rib being substantially parallel to the plurality of barrier ribs; and at least one second sub barrier rib connected to the first sub barrier rib and the outermost barrier rib.

14. The plasma display panel of claim 13, wherein the first sub barrier rib has a width that is substantially identical to a width of one of the plurality of barrier ribs.

15. The plasma display panel of claim 13, further comprising a plurality of sustain electrodes formed on a surface of the second substrate that faces the first substrate, the plurality of sustain electrodes including pairs of sustain electrodes, each pair corresponding to a row of the discharge cells, wherein the at least one second sub barrier rib is mounted between at least one of the pairs of sustain electrodes.

16. The plasma display panel of claim 13, wherein the plurality of barrier ribs are formed in a lattice pattern.

17. The plasma display panel of claim 13, wherein the plurality of barrier ribs and the first sub barrier rib are formed in a striped pattern.

18. The plasma display panel of claim 13, wherein the plurality of barrier ribs include a secondary outermost barrier rib connected to the outermost barrier rib and forming a discharge cell with at least one other of the plurality of barrier ribs.

19. The plasma display panel of claim 18, wherein a distance: between the outermost barrier rib and the secondary outermost barrier rib is less than a distance between others of the plurality of barrier ribs.

20. The plasma display panel of claim 13, wherein the at least one second sub barrier rib is substantially orthogonal to the first sub barrier rib and the outermost barrier rib.

21. The plasma display panel of claim 13, wherein the at least one second sub barrier rib has a height that is substantially identical to a height of the first sub barrier rib.

* * * * *